United States Patent [19]

Hockensmith

[11] 4,406,375

[45] Sep. 27, 1983

[54] TELESCOPIC BOOM CONSTRUCTION

[75] Inventor: John L. Hockensmith, Chambersburg, Pa.

[73] Assignee: JLG Industries Inc., McConnellsburg, Pa.

[21] Appl. No.: 165,627

[22] Filed: Jul. 2, 1980

[51] Int. Cl.[3] ..... B66C 23/04

[52] U.S. Cl. ..... 212/268; 212/267; 212/269

[58] Field of Search ..... 212/230, 231, 264, 268, 212/269; 52/115, 118, 121; 187/9 E; 198/813, 816

[56] References Cited

U.S. PATENT DOCUMENTS

| | | | |
|---|---|---|---|
| 2,379,333 | 6/1945 | Athy . | |
| 2,896,750 | 7/1959 | Eitel . | |
| 3,101,145 | 8/1963 | Koski et al. | 198/813 |
| 3,212,604 | 10/1965 | Garnett . | |
| 3,243,052 | 3/1966 | Grove . | |
| 3,423,890 | 1/1969 | Leigh . | |
| 3,620,579 | 11/1971 | Brown et al. . | |
| 3,690,742 | 9/1972 | Sung . | |
| 3,809,249 | 5/1974 | Grove . | |
| 4,088,200 | 5/1978 | Cowley et al. . | |
| 4,112,649 | 9/1978 | Fritsch et al. . | |
| 4,133,411 | 1/1979 | Curb . | |

*Primary Examiner*—Robert G. Sheridan

*Attorney, Agent, or Firm*—Richard B. O'Planick

[57] ABSTRACT

A multi-section telescopic lifting boom which is extended and retracted at least in part by chains having their ends secured to one section, engaging sprockets carried by another section and connected at an intermediate point to a third section. Telescopic elements which are completely separated during boom extension are provided with inclined guide surfaces to insure entry of the smaller element into the surrounding element. Extension and retraction is effected by a linear hydraulic motor connected to a cylinder box which is pivoted to section adjacent the the base section; anti-friction pads are carried at the bottom of the outer end of the cylinder box and engage longitudinally extending tubes on the bottom plate of the next section, the tubes extending higher than the extension and retraction chains, which are positioned between the tubes. The chains are provided in parallel, at least one end of each chain being connected to a yoke which is adjustably secured by a threaded member.

14 Claims, 8 Drawing Figures

TELESCOPIC BOOM CONSTRUCTION

BACKGROUND OF THE INVENTION

The present invention relates to telescopic booms used for lifting loads.

Telescopic booms have been used on cranes, for lifting various loads, and have also been used on aerial lift platform apparatus, for supporting a workman's platform at the outer end of the boom. These booms are made in desired lengths, and some have extended as high as approximately 110 feet, more or less. In the construction of booms of such size, a number of problems arise. When one section of the telescopic boom is caused to extend outwardly of the larger section which surrounds it, and is then caused to retract, it is necessary that all of the elements which are intended to pass adjacent to each other are prevented from striking in such a manner as to lock the boom against further retraction. This problem has been recognized to a certain extent in the prior art. For example, Grove U.S. Pat. No. 3,243,052 provides a metal skid with a rounded end on the outer end of a cylinder box, in a multi-section telescopic lifting boom. The skid extends downwardly from the cylinder block, and is intended for permitting the bottom plate of a section of the boom to move past the skid, without locking. Brown Et Al U.S. Pat. No. 3,620,579 provides a plurality of cylinders with inclined elements or ramps for this same purpose. The constructions heretofore provided, however, have not taken into consideration the possibility that other elements than those at the bottom of the various boom sections may have meeting surfaces which could cause a lockup of the boom on retraction, nor have there been provided other than simple inclined metalic surfaces for this purpose.

Further, it is known to extend and retract the sections of a telescopic boom by use of both a hydraulic motor and chains or cables. For example, Grove U.S. Pat. No. 3,809,249 discloses a telescopic boom having three sections, and a cylinder box. A hydraulic motor or cylinder has an end pin-connected to the base section, and has the outer end of the piston rod pivotally connected to a cylinder box, which extends rearwardly from the pin connection, and is, itself, connected at its rear end to the rear end of the mid section. Sprockets are carried near the rear end of the mid section and at the front end of the mid section, and a chain extends from the front of the base section rearwardly around the rear sprocket, and is engaged with the rear of the fly section, the chain, or a companion chain, extending from the rear end of the fly section forwardly around a sprocket at the forward end of the mid section, and thence rearwardly to an anchor at the outer end of the base section. By this construction, the cylinder causes the mid section to extend and retract, and movement of the mid section causes the fly section, also, to extend and retract, through the chains just described. Where booms are intended to be of greater length than may be suitably constructed in three sections, they are made of four, or more, sections, and in view of the additional sections, additional problems are encountered. For example, where the cylinder box is pivoted, it is possible that it will engage the chain or chains for the outer section or sections of the boom, and such engagement is required to be prevented, to avoid lockup, interference or undue wear on the parts of the boom. It has been proposed to provide a construction in which an elongated spacer is provided for supporting a cylinder box, and a wear pad is positioned between a pair of cables for supporting the mid section of the boom on the base section. Such prior art disclosures are deficient, however, in providing a relatively friction-free construction for longitudinal movement of the cylinder box relative to a section of the boom, together with maintaining the elevation of the cylinder box so as to prevent interference with the actuating chains.

In connection with the provision of chains for actuating an outer section of a boom, such as is shown in Grove U.S. Pat. No. 3,809,249, there have been provided anchors for the chains which may be tightened, so as to thereby tighten the chains, as they wear under use and tend to lengthen. Such anchors have been provided individually for each chain, and are of a threaded nature. It is difficult in such constructions, however, to tension the chains equally.

SUMMARY OF THE INVENTION

The present invention is directed to a multi-section telescopic lifting boom having a cylinder box in association with a linear hydraulic motor for extending and retracting the base section and the next adjacent section. One or more additional sections are provided, which are moved by chains placed in parallel arrangement. At least one telescopic element is entirely separated from another telescopic element during boom extension, and is provided with inclined guide surfaces on the top, sides and bottom, preferably of both cooperating telescopic elements, so as to insure entry of the smaller element into the surrounding element in telescopic manner. These meeting surfaces are particularly provided on the cylinder box and on the fly section of the boom. The cylinder box is pivotally connected to the extensible section adjacent to the base section, at the rear end of the cylinder box and said section, and thereby the cylinder box is free to pivot about that pivotal connection; the cylinder box is provided with downwardly extending wear-resistant blocks, and a bottom plate is provided with longitudinally extending support surfaces positioned for engagement by said wear-resistant blocks, the support surfaces preferably being part of longitudinally extending tubes secured to the bottom plate of the noted section, and the supporting surfaces of these tubes extending above the level to which chains extending between these tubes may rise or occupy, thereby to avoid lockup.

Among the objects of the present invention are the provision of a telescopic multi-section lifting boom having improved meeting portions for the prevention of boom lockup or blocking. Another object is to provide such a telescopic boom in which the meeting portions are of improved construction, providing great reliability and being long lasting in use. Another object of the present invention is to provide a construction of this type having improved means to prevent interference with the actuating chains. Yet another object of the present invention is the provision of a telescopic boom in which at least one section is extended and retracted by a pair of chains in parallel, and having improved means for adjusting the tension on the chains equally.

Other objects and many attendant advantages will be readily understood from the following specification, claims and drawings.

DESCRIPTION OF THE PREFERRED EMBODIMENT

Figure 1:
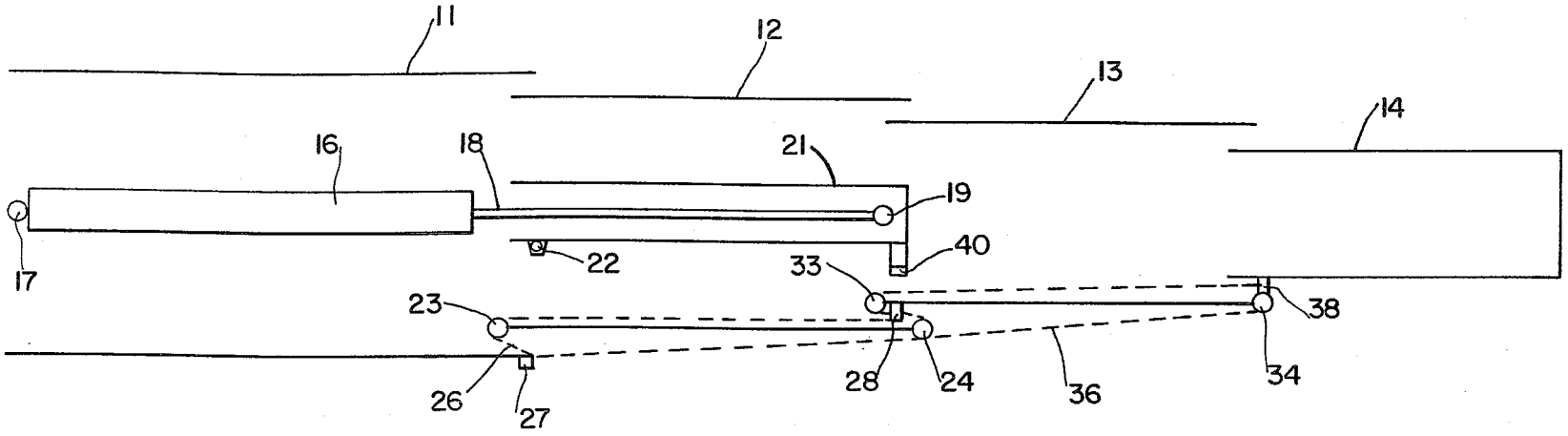
FIG. 1 is a schematic, sectional view of a telescopic crane boom in accordance with the present invention in extended position.

Referring now to the drawings, wherein like or corresponding reference numerals are used for like or corresponding parts throughout the several views, there is shown in FIG. 1 a telescopic crane boom 10 which includes a base section 11, an inner mid section 12, an outer mid section 13, and a fly section 14. A linear hydraulic motor 16 has the rear end of the cylinder thereof connected by a pin 17 to the side walls of the base section 11, at the rear thereof. The piston rod 18 extends forwardly, and is connected by a pin 19 to the side walls of a cylinder box 21. The cylinder box 21 is connected adjacent its inner end by a pin 22 to side walls of the inner mid section 12. To extend and retract the outer mid section 13, the inner mid section 12 is provided at its rear end with a pair of sprockets 23, and at its outer end with a pair of sprockets 24. A pair of chains 26, as shown in dashed lines, extend from an anchor 27 on the bottom plate of the base section 11, through an aperture in said bottom plate adjacent the outer end thereof, and thence rearwardly around the sprockets 23, and thence forwardly to an anchor 28 at the rear of the outer mid section 13. A second pair of chains or a second portion of the chains 26 extend from the anchor 28 around the sprockets 24 carried at the outer end of the inner mid section 12, and thence rearwardly to the anchor 27 at the outer end of the base section 11. To extend and retract the fly section 14, a similar arrangement is provided, including sprockets 33 at the rear of the outer mid section 13 and sprockets 34 at the outer end of the outer mid section 13. A pair of chains 36 extends around these sprockets, being attached to an anchor 38 adjacent the inner end of the fly section 14, and to the outer end of the inner mid section 12.

Figure 1A:
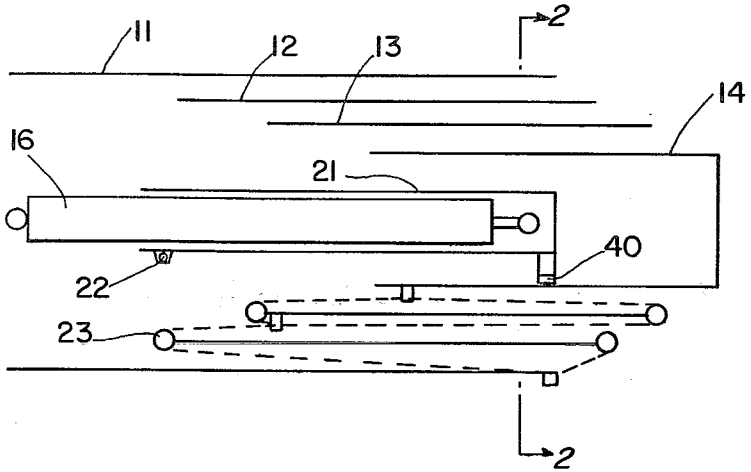
FIG. 1A is a view similar to FIG. 1, with the boom retracted.

In FIG. 1A, the four section telescopic boom 10 is shown in retracted position, in which a wear block 40 may be seen to engage the bottom plate of the fly section 14.

Figure 2:
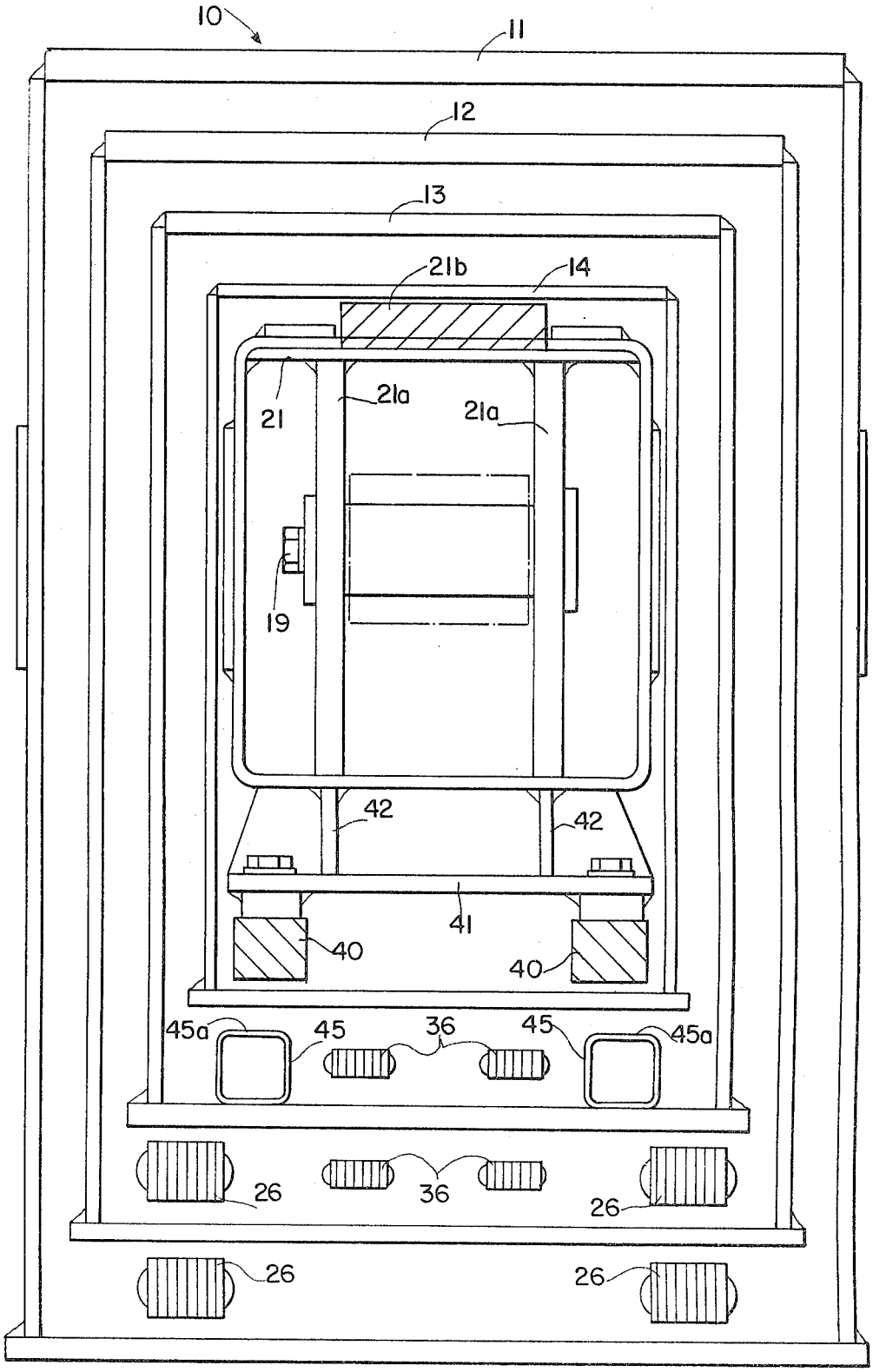
FIG. 2 is a cross-sectional view taken on the line 2—2 of FIG. 1A.

Referring now to FIG. 2, there may be seen the boom in transverse cross-section, including the base section 11, inner mid section 12, outer mid section 13 and fly section 14. Each of these boom sections is in the shape of a hollow rectangle, having top and bottom plates and side plates, as is known in the art. The cylinder box 21 is a hollow tube of generally square or rectangular configuration, and is thereby congruant in cross-sectional shape with the boom sections. The pin 19 may be seen for connecting the outer end of the cylinder rod 18 to the cylinder box 21, by being connected to a pair of reinforcing plates 21*a* which are connected to the top and bottom of the cylinder box 21. A wear pad 21*b* is carried by the top of the cylinder box 21 for engagement with the underside of the top plate of the fly section 14 in the retracted condition of the boom 10. Other wear pads, not shown, are provided as is known in the art.

Between the bottom plate of the base section 11 and the bottom plate of the inner mid section 12 there are shown, in cross-sections, a pair of chains 26, it being understood that these chains are, in known fashion, provided in parallel, and each of the chains designated 26 having an upper run and a lower run. Each of the chains 26 has been herein described as being, in fact, two chains, one extending between the anchor 27 (FIG. 1) around the sprocket 23 and thence to the anchor 28, and the other extending from the anchor 28, around the sprocket 24 and then to the anchor 27; it will be understood that a single continuous length of chain may be used for each of the two parallel chains, and also that a similar construction is provided in connection with the chain 36, for actuation of the fly section 14.

Also shown in FIG. 2 are the parallel chains 36, with the lower runs thereof extending between the bottom plate of inner mid section 12 and the bottom plate of outer mid section 13, with the upper run thereof extending above the bottom plate of outer mid section 13, and below the bottom plate of fly section 14.

At the bottom plate of the cylinder box 21 there is a depending structure for supporting a pair of laterally spaced wear resistant blocks 40. The structure includes a horizontal plate 41, and a pair of vertical plates 42 secured to the bottom plate of the cylinder box 21. On the bottom plate of the outer mid section 13 are a pair of longitudinally extending tubes 45, each having an upper surface 45*a* which is in position substantially directly beneath the wear resistant blocks 40, for engagement thereby in certain positions of the boom when extended, referring to FIGS. 1 and 1A, from the retracted position to the extended position, during which the inner end of the fly section 14 will have passed outwardly of the wear resistant blocks 40, which will then engage the surfaces 45*a*, due to the pivoting of the cylinder box 21 about the pivot pin 22.

Figure 3:
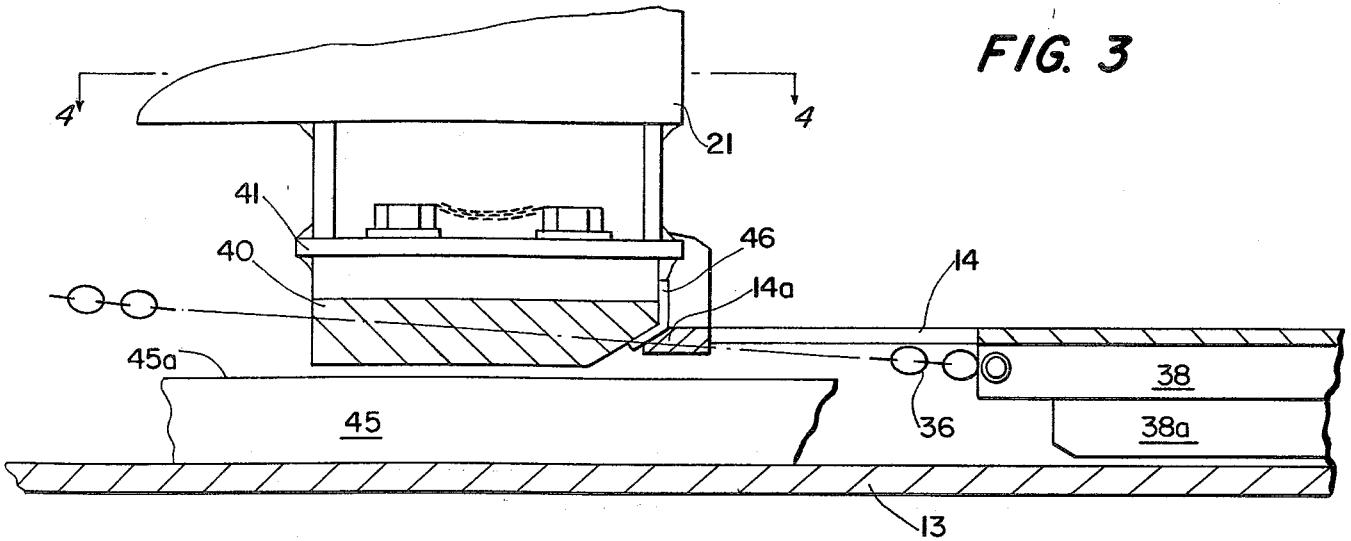
FIG. 3 is a cross-sectional view showing the outer end of the cylinder box and the inner end of the fly section in meeting position.

Referring now to FIG. 3 there is shown an enlarged cross-sectional view of the outer end of the cylinder box 21 together with adjacent structure, the parts being in the position where meeting portions of the cylinder box 21 and more particularly the wear resistant blocks 40 and the inner end of the bottom plate of the fly section 14 have just reached engagement. Thus, there may be seen the plate 41 of the supporting structure depending below the outer end of the cylinder box 21, supporting the wear resistant block 40 which is of a suitable resin material. The outer end of the wear resistant block 40 is inclined, downwardly from front to rear as shown, and there is provided a wear plate 46 which defines and provides the meeting portion of the bottom of the cylinder box 21. The inner end of the bottom plate of fly section 14 is provided with a similarly inclined guide surface 14*a*, thereby providing the meeting portion of the bottom of the fly boom 14. Accordingly, upon retraction of the boom 10 the plate 46 will be in position to be engaged by the surface 14*a*, and will serve to elevate the outer end of the cylinder box 21, so as to cause it to rise up, the bottom surface of the wear resistant blocks 40 then engaging the upper surface of the upper plate of fly section 14.

There may also be seen in FIG. 3 a tube 45 mounted on the bottom plate of the outer mid section 13, as well as the anchor 38 on the fly boom 14, to which the chain 36 is attached. A wear pad 38*a* is provided beneath the anchor 38.

Figure 4:
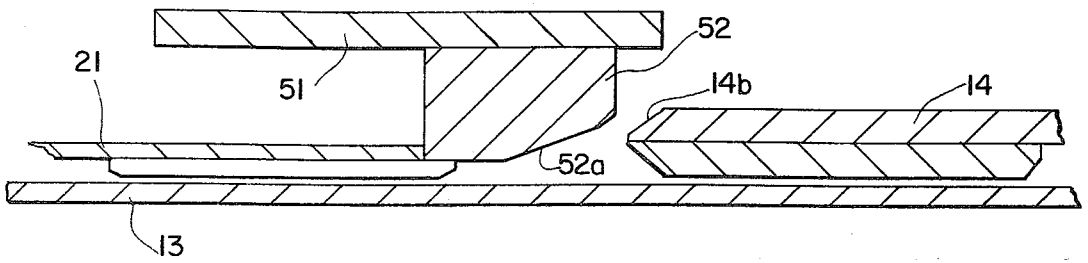
FIG. 4 is a cross-sectional view taken on the line 4—4 of FIG. 3.

In FIG. 4, there is shown a side wall of the cylinder box 21, having adjacent thereto a reinforcing plate 51, there being provided at the forward end of the side wall 21 of the cylinder box a block 52 which has an inclined guide surface 52*a* which defines the meeting portion of the side wall of the cylinder box 21. A side wall of the fly boom 14 is shown, having an inclined surface 14*b*, providing the meeting portion of the side of fly boom 14. Also shown is the side wall of the outer mid section 13. As will be understood, the opposite side walls have a construction substantially identical to that shown in FIG. 4, so that should there be an angular deviation of the fly section in a manner to engage either of its side walls with the cylinder block, the meeting portions thereof will engage, and the guide surfaces will insure the entry of the cylinder box 21 into the fly section 14.

Figure 5:
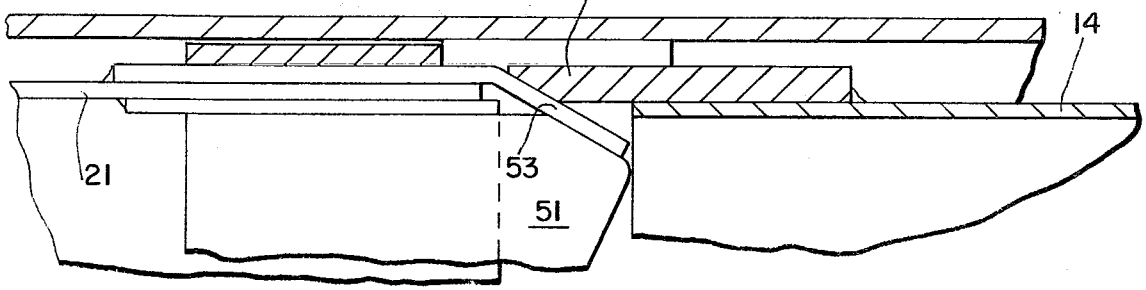
FIG. 5 is a view similar to FIG. 3, and showing the top of the cylinder box and of the fly boom in meeting position.

Referring now to FIG. 5, there may be seen the upper or top plate of the cylinder box 21, and the substantially parallel top plate of the fly section 14. A pusher 14*c* is provided on the top plate of fly section 14, at the inner end thereof. On the top of the cylinder box 21 there is provided a guide in the form of an inclined striker plate 53, which extends into the path of the pusher 14*c* when the fly section 14 is retracted. The reinforcing plate 51 is in engagement with the inclined portion of the striker 53, to thereby support both it and the block 52.

Figure 6:
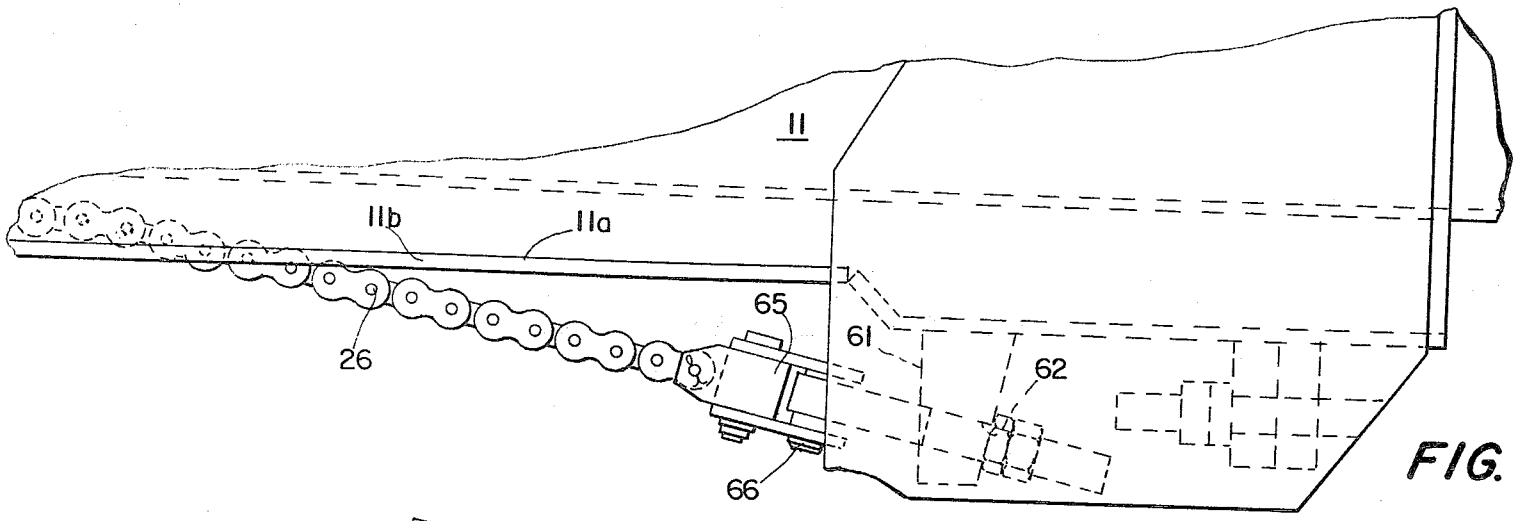
FIG. 6 is an enlarged elevational view of the portion of FIG. 1 within the circle designated 6.
Figure 7:
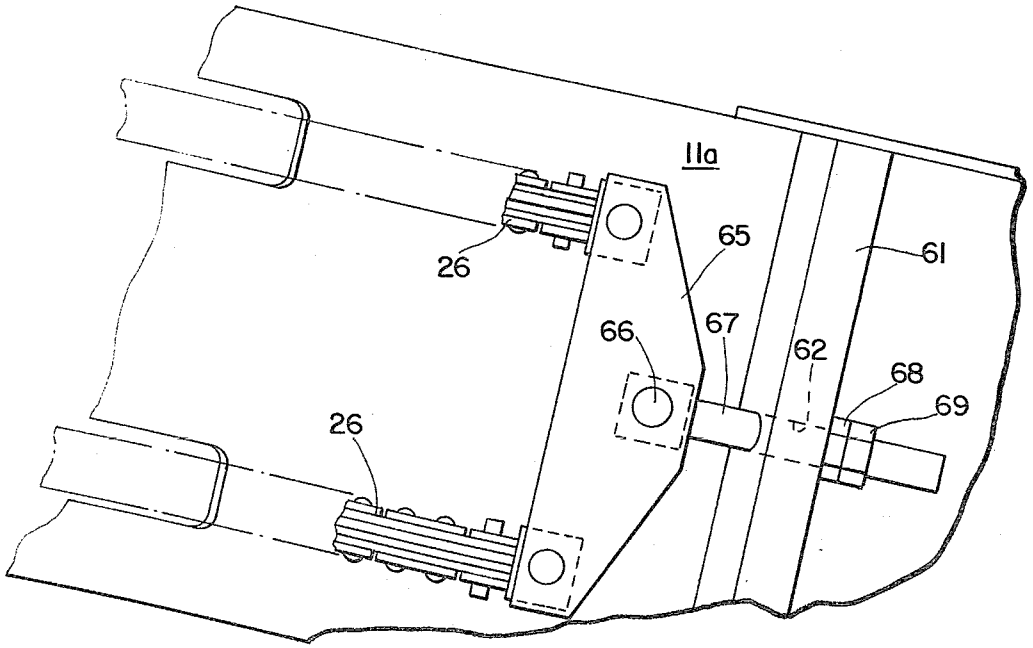
FIG. 7 is a view taken on the line 7—7 of FIG. 6.

Referring now to FIG. 6, there is shown in elevation the outer end of the base section 11, the bottom plate 11*a* of which has an opening or aperture 11*b* to permit passage therethrough of the chains 26. Depending from the bottom plate of the base section 11 is a transverse plate 61 having an opening 62 therethrough. A yoke 65 is provided, extending laterally, as shown in FIG. 7, of the base section 11 bottom plate 11*a*. One of the chains 26 has an end secured to one end of the yoke 65, and the other end of the yoke 65 has the other chain 26 secured to it. A transverse pin 66 is carried by the yoke 65, and a threaded bolt 67, midway between the chains 26, has one end journaled on the pin 66, the bolt 67 extending through the opening 62, there being a pair of nuts 68 and 69 threaded on the bolt 67, the nut 68 engaging a surface of the plate 61. By this construction, when the chains 26 become elongated through extended usage and consequent wear, adjustment may be made by using the nut 68 to draw more of the bolt 67 through the opening 62, and thus move the yoke 65 in a direction to tension both of the chains 26 equally and simultaneously.

There has been provided a multi-section lifting boom having improved meeting portions at the inner end of the fly section and the outer end of the cylinder box to prevent boom lockup, or the blocking of entry of the cylinder box into the fly section. Further, the meeting portions are of improved construction, having great strength and being capable of long wear in use. Prevention of engagement of any of the parts of the boom in an interfering manner with the actuating chains is accomplished through the use of support surfaces provided at a location above the level of such actuating chains, and wear resistant blocks supported on a depending structure at the outer end of the cylinder box, to prevent the cylinder from engaging the chains. In addition, there has been provided a multi-section telescopic boom in which at least one section is actuated by means of a pair of chains in parallel, and with improved anchoring of the chains to provide for simultaneous and equal adjustment thereof.

It will be obvious to those skilled in the art that various changes may be made without departing from the spirit of the invention, and therefore the invention is not limited to what is shown in the drawings and described in the specification but only as indicated in the appended claims.

I claim:

1. A multi-section telescopic lifting boom includes a base section and movable sections, a motor for extending and retracting the boom movable sections, a cylinder box pivotally connected adjacent its inner end to a boom section adjacent the base section and having the motor connected to said cylinder box, means for moving one said movable section between a first position in which it is at least partially telescoped over said cylinder box and a second position in which the inner end thereof is beyond the outer end of the cylinder box, meeting portions on the outer end of said cylinder box and the inner end of of said one section, and guide surface means on at least one of the meeting portions for guiding said cylinder box into said one movable section; said cylinder box and said one section each having a top plate in substantially parallel, adjacent relationship when said one section is in said first position, pusher means on the inner end of said top plate of said one section, and said guide means comprising inclined striker means on the outer end of said cylinder box extending into the path of said pusher means upon movement of said one section to said first position.

2. The lifting boom of claim 1, said pusher means having an inclined surface in facing cooperative relationship to the inclined striker means.

3. The lifting boom of claim 2, said pusher means extending rearwardly of the inner end of said top plate of said one section.

4. The lifting boom of claim 1, said cylinder box and said one section each having a pair of spaced, parallel side plates, respective ones of which are in substantially parallel, adjacent relationship when said one section is in said first position, said meeting portions being on said side plates; wherein the meeting portions of said cylinder box side walls comprises striker elements on the outer end thereof extending into the path of the meeting portion of the side walls of said one boom section.

5. The lifting boom of claim 4, said striker elements comprising blocks, said cylinder box comprising a pair of reinforcing plates at the outer end thereof each parallel to and in spaced relation to a said cylinder box side wall, each said block engaging a said reinforcing plate.

6. The lifting boom of claim 4, said cylinder box and said one section further comprising top plates in substantially parallel adjacent relationship when said one section is in said first position, said top plates having meeting portions and at least one thereof having guide surface means for guiding said cylinder box into said one section; said cylinder box comprising reinforcing plates parallel to and inwardly of the side plates thereof, said guide means comprising striker means on the outer end of said cylinder box top plate and on said side walls, said reinforcing plate supporting said striker means.

7. The lifting boom of claim 6, said one section having a bottom plate and said cylinder box at the outer end thereof adjacent the bottom having meeting portions and at least one thereof having guide surface means for guiding said cylinder box into said one section.

8. The lifting boom of claim 1, said one section having a bottom plate, said meeting portion of said cylinder box being adjacent the bottom thereof and the meeting portion of said one section being on the bottom plate thereof.

9. The lifting boom of claim 8, wherein said meeting portion of said cylinder box comprises a pair of laterally spaced wear-resistant blocks, a second movable boom section having a bottom plate, said second boom section telescopically receiving said first movable boom section therein and being next adjacent to said first movable boom section, said second movable boom section having longitudinally extending support surfaces positioned for engagement by said wear-resistant blocks when said cylinder block is not within said first section.

10. The lifting boom of claim 9, wherein said means for moving said one movable section comprising chain means, said support surfaces being above the level of said chain means.

11. The lifting boom of claim 10, wherein said chain means comprises a pair of chains in parallel relationship, an anchor for adjacent ends of said chains comprising a yoke, means connecting the ends of said chains to said yoke, and threaded means for adjustably moving said yoke to tension said chains equally.

12. A multi-section telescopic lifting boom comprising a base section, and at least three movable sections, a cylinder box, means for pivotally connecting the cylinder box and a first said movable section substantially adjacent the inner ends thereof, extensible motor means connected to said base section and to said cylinder box for extending and retracting said first movable section, anti-friction means on the bottom of the cylinder box adjacent the outer end thereof, means for extending and retracting the other movable sections upon extension and retraction of said first movable section by said motor means, a second said movable section having a first position in which it is at least partially telescoped over said cylinder box and a second position in which the inner end thereof is beyond the outer end of the cylinder box, and a third said movable section having longitudinally extending support surface means positioned for engagement by said anti-friction means when said second movable section is in a said second position thereof; said anti-friction means comprising a pair of laterally spaced blocks, and means for supporting said blocks spaced from the bottom of said cylinder box.

13. The multi-section lifting boom of claim 12, said means for extending and retracting said other movable sections comprising chain means extending in part adjacent the bottom of said third section and means for supporting said support surface means above the level of the part of said chain means extending adjacent the bottom of said third section.

14. The multi-section lifting boom of claim 12, said chain means comprising a pair of chains in parallel relationship, an anchor for adjacent ends of said chains comprising a yoke, means connecting the ends of said chains to said yoke, and threaded means for adjustably moving said yoke to tension said chains equally.

* * * * *